US008789711B2

(12) United States Patent
Haltmayer et al.

(10) Patent No.: US 8,789,711 B2
(45) Date of Patent: Jul. 29, 2014

(54) DISHWASHER WITH CROCKERY BASKET HAVING ADJUSTABLE STORAGE TRAY

(75) Inventors: Werner Haltmayer, Dinkelsbühl (DE); Mathias Herrmann, Nattheim (DE); Stefan Kasbauer, Dillingen (DE); Claus Köther, Bächingen (DE); Martin Weissenburger, Bissingen (DE); Mark Woldenberg, Bachhagel (DE)

(73) Assignee: BSH Bosch und Siemens Hausgeraete GmbH, Munich (DE)

( * ) Notice: Subject to any disclaimer, the term of this patent is extended or adjusted under 35 U.S.C. 154(b) by 329 days.

(21) Appl. No.: 13/258,487

(22) PCT Filed: Mar. 17, 2010

(86) PCT No.: PCT/EP2010/053449

§ 371 (c)(1),
(2), (4) Date: Sep. 22, 2011

(87) PCT Pub. No.: WO2010/115689

PCT Pub. Date: Oct. 14, 2010

(65) Prior Publication Data

US 2012/0031861 A1 Feb. 9, 2012

(30) Foreign Application Priority Data

Apr. 7, 2009 (DE) ..... 10 2009 002 270

(51) Int. Cl.
*A47L 15/50* (2006.01)

(52) U.S. Cl.
CPC ..... *A47L 15/505* (2013.01)
USPC ..... 211/41.9

(58) Field of Classification Search
CPC ..... A47L 15/50; A47L 15/505
USPC ..... 211/41.3, 41.4, 41.8, 41.9; 220/487, 220/488
See application file for complete search history.

(56) References Cited

U.S. PATENT DOCUMENTS 1,125,444 A * 1/1915 Barley ..... 211/85.25
1,285,000 A * 11/1918 Blakeslee ..... 220/572

(Continued)

FOREIGN PATENT DOCUMENTS

DE 1929184 U 12/1965
DE 8335417 U1 3/1984

(Continued)

OTHER PUBLICATIONS

International Search Report PCT/EP2010/053449.

(Continued)

*Primary Examiner* — Michael Safavi
(74) *Attorney, Agent, or Firm* — James E. Howard; Andre Pallapies

(57) ABSTRACT

A dishwasher, especially a household dishwasher, at least comprising a crockery basket provided with a storage tray for items to be washed, said storage tray comprising at least one holding device to be brought into contact with a first section of the crockery basket in order to fix to the crockery basket in a first storage position for placing items to be washed. According to the invention, the holding device is designed to be brought into contact with a second section of the crockery basket in order to fix to the crockery basket in a second storage position for placing items to be washed.

30 Claims, 5 Drawing Sheets

(56) References Cited

U.S. PATENT DOCUMENTS

| | | | | | |
|---|---|---|---|---|---|
| 1,452,418 | A * | 4/1923 | Cunneen | 211/41.3 |
| 1,453,437 | A * | 5/1923 | Burnham | 211/41.3 |
| 2,586,005 | A * | 2/1952 | Colonna | 220/487 |
| 3,245,548 | A * | 4/1966 | Sol Kesilman et al. | 211/41.2 |
| 3,252,582 | A * | 5/1966 | Sol Kesilman et al. | 211/41.2 |
| 4,157,145 | A * | 6/1979 | Jordan | 220/487 |
| 4,606,464 | A * | 8/1986 | Jordan et al. | 211/41.8 |
| 4,726,475 | A * | 2/1988 | Ferenzi | 211/41.5 |
| 4,927,033 | A * | 5/1990 | Patera et al. | 211/41.9 |
| 5,249,590 | A * | 10/1993 | Jacobus et al. | 134/135 |
| 5,918,749 | A * | 7/1999 | Pille et al. | 211/41.9 |
| 6,123,204 | A * | 9/2000 | Nelson et al. | 211/41.9 |
| 7,231,929 | B2 * | 6/2007 | Landsiedel et al. | 134/135 |
| 7,644,826 | B2 * | 1/2010 | Koch et al. | 211/41.4 |
| 7,665,475 | B2 * | 2/2010 | Hedstrom et al. | 134/134 |
| 8,167,147 | B2 * | 5/2012 | Frankel et al. | 211/41.3 |
| 2005/0241686 | A1 * | 11/2005 | Woo | 134/135 |
| 2006/0237379 | A1 * | 10/2006 | Yang et al. | 211/41.4 |
| 2007/0039904 | A1 * | 2/2007 | Purushothaman | 211/41.8 |
| 2007/0039905 | A1 * | 2/2007 | Purushothaman | 211/41.8 |
| 2007/0131696 | A1 | 6/2007 | Schessl et al. | |
| 2007/0199584 | A1 | 8/2007 | Koch et al. | |
| 2009/0120883 | A1 * | 5/2009 | Jadhav et al. | 211/41.9 |

FOREIGN PATENT DOCUMENTS

| | | | | |
|---|---|---|---|---|
| EP | 1859722 | A1 * | 11/2007 | A47L 15/50 |
| EP | 1925251 | A2 | 5/2008 | |
| EP | 2095755 | A1 | 9/2009 | |
| GB | 1145516 | A | 3/1969 | |
| WO | 0187133 | A1 | 11/2001 | |
| WO | WO 2009062052 | A1 * | 5/2009 | A47L 15/50 |

OTHER PUBLICATIONS

Report of Examination DE 10 2009 002 270.8.

* cited by examiner

DISHWASHER WITH CROCKERY BASKET HAVING ADJUSTABLE STORAGE TRAY

BACKGROUND OF THE INVENTION

The invention relates to a dishwasher.

DE 83 35 417 U1 discloses a dishwasher having a crockery basket comprising a storage tray for items to be washed. The storage tray for items to be washed can be attached at a distance from a crockery basket base to a crockery basket side wall. The storage tray comprises hooks which are arranged along a bearing strut and by means of which the storage tray can be swivel-mounted on a cross wire of the crockery basket. In its swiveled-down usage position it is possible to place pieces of crockery, for example cups, eggcups or glasses between the storage tray for items to be washed and the crockery basket base, while on the top side of the storage tray for items to be washed it is additionally possible to store items of cutlery.

BRIEF SUMMARY OF THE INVENTION

The object of the invention consists in providing a dishwasher having a crockery basket comprising a storage tray for items to be washed which can easily be adapted to different requirements.

The object of the invention is achieved on the basis of a dishwasher, especially a household dishwasher, at least having a crockery basket comprising a storage tray for items to be washed, wherein the storage tray for items to be washed comprises at least one holding device to be brought into engagement with a first section of the crockery basket in order to be fixed to the crockery basket in a first storage position for placing items to be washed.

According to the invention it is provided that the holding device is configured to be brought into engagement with a second section of the crockery basket in order to be fixed to the crockery basket in a second storage position for placing items to be washed. This enables the storage space to be adapted in a simple manner to the respective requirements, e.g. to increase the clear height between the storage tray for items to be washed and the crockery basket base in order to be able to place e.g. tall glasses in this area. On the other hand it is also possible to reduce the clear height in this area so that more clear height is available in the area above the storage tray for items to be washed, i.e. on the storage tray for items to be washed.

To this end, it is provided in a development that the storage tray for items to be washed comprises at least one second holding means to be brought into engagement with a second section of the crockery basket in order to be fixed to the crockery basket in a second storage position for placing items to be washed.

The crockery basket can in principle be any type of container suitable for placing items to be washed in a dishwasher, for example a plastic trough with openings to allow wash liquor to run off, which can additionally also comprise sections provided with wires, for example. Preferably, however, it is provided that the crockery basket is formed at least in sections from wires which are embodied as cross wires and/or longitudinal wires, wherein the holding means are configured to be brought into engagement with the cross wires and/or longitudinal wires in the respective sections of the crockery basket. In this arrangement the cross wires and longitudinal wires can be interconnected in order to form a grid structure.

In a development it is provided that the holding device or at least one holding means is configured to be brought into engagement with a cross wire in the first section. In this case the cross wire extends essentially horizontally, for example in the area of a side wall of the crockery basket, when the crockery basket is in its usage position. This permits a particularly simple embodiment of the holding means e.g. as latching hooks which grip around a section of a cross wire and at the same time additionally permit the storage tray for items to be washed to be swiveled, e.g. in order to move the storage tray for items to be washed from a usage position into a non-usage position by means of a pivoting motion.

It is furthermore provided in a development that the holding device or the two holding means are configured to be brought into engagement with cross wires in the respective sections. Hence, only cross wires are used for the attachment, which simplifies use.

In another development it is provided that the holding device or at least one holding means is configured to be brought into engagement with longitudinal wires in one of the sections. In this case the longitudinal wires extend essentially perpendicularly, for example in the area of a side wall of the crockery basket, when the crockery basket is in its usage position. This enables the use of the longitudinal wires. This is especially advantageous when the holding means are only intended to enable the fixing of the storage tray for items to be washed on the crockery basket without the possibility of swiveling the storage tray for items to be washed between a usage and a non-usage position.

In a development it is provided that wires in the first section of the crockery basket have a different cross-section than wires in the second section of the crockery basket. In this case the wires can differ with respect to their shape and/or their dimensions in order in a simple way to ensure an unambiguous assignment of the holding means to the respective sections of the crockery basket.

To this end, it is provided in a first development that the cross-sections are embodied as essentially round, i.e. have an essentially circular cross-section, for example.

In this case it is provided in a development that the diameters of the cross-sections differ from each other. Hence, the holding means are adapted to the respective cross-section and assignment errors on the part of a user are excluded.

In an alternative development it is provided that the cross-sections have different shapes. In this case the holding means are adapted to the respective cross-sectional shape so that in this case once again assignment errors on the part of a user are excluded.

In a development the storage tray for items to be washed has a different angular position in the first storage position than in the second storage position. In this way, for different items to be washed, it is possible to provide in each case a storage surface in a suitable angular position, which ensures that the items to be washed can always be stored in a stacking position on the storage tray for items to be washed in which the liquid can drip off completely after the end of the dishwashing cycle.

In particular when cups are stacked upside down on the storage tray for items to be washed there is a risk that liquid will remain in the concave cup base and be unable to drip off. For stacking cups of this kind it is provided according to the invention for the storage tray for items to be washed to be arranged in the storage position at a greater angle of inclination. When stacking pieces of cutlery, on the other hand, the storage tray for items to be washed can be put into the storage position at a lesser angle of inclination.

In one embodiment variant the storage tray for items to be washed can be brought at least by means of a swiveling motion from the first storage position into the second storage position and vice versa. The first storage position can be an upper knife storage position, while the second position can be a lower cup storage position. The height position of the storage tray for items to be washed can therefore be varied according to the intended use, i.e. according to the size of the items to be washed that are to be stacked.

For example, for a knife storage function, the storage tray for items to be washed can be suspended in an upper position on the crockery basket side wall, since for stacking knives or the like, only a reduced stacking space is required above the storage tray for items to be washed. In the upper knife storage position, the stacking space beneath the storage tray for items to be washed is dimensioned as correspondingly large and can be used for stacking larger pieces of crockery.

For the cup storage function, on the other hand, a larger stacking space is required above the storage tray for items to be washed. In this case, therefore, the storage tray for items to be washed is suspended in the lower cup storage position on the crockery basket side wall.

For optimum drying, as mentioned above, a slightly inclined position of the cups stacked on the storage tray for items to be washed is advantageous. In its lower cup storage position, the storage tray for items to be washed can therefore be inclined at an angle upward from the horizontal, which can be in a range of 20 to 30°. On the other hand, the storage tray for items to be washed can be arranged in its upper knife storage position in an approximately horizontal plane.

The storage tray for items to be washed can also comprise first and second holding means, each adapted to hold the storage tray in the upper knife storage position and in the lower cup storage position.

To hold the storage tray for items to be washed reliably, each of the holding means together with the crockery basket side wall can form a pivot point at which the storage tray for items to be washed is hinged about a tilt axis. The storage tray for items to be washed can optionally be tilted about the tilt axis between a usage position and a vertically raised non-usage position. For reliable holding, the storage tray for items to be washed can have a bearing strut facing the crockery basket side wall with which the storage tray for items to be washed can be supported by means of a tilting moment against the crockery basket side wall. Hence, the bearing strut of the storage tray for items to be washed functions as a force transducer in order to divert operationally induced bending moments formed on the storage tray for items to be washed into the crockery basket side wall.

Hence, depending upon the intended use, the first holding means or the second holding means can form a tilt axis of the storage tray for items to be washed. The two first and second holding means can be spaced apart from the aforementioned bearing strut of the storage tray for items to be washed by different lever arm lengths. Depending upon the lever arm length between the first/second holding means and the bearing strut, the storage tray for items to be washed is supported in different angular positions on the crockery basket side wall. The lever arm lengths can be dimensioned such that a horizontal alignment of the storage tray for items to be washed is obtained for the upper knife storage position, while the storage tray for items to be washed in the lower cup storage position is inclined at an angle, as already mentioned above.

Preferably, the first and second holding means can each comprise at least one hook which grips around a cross wire of the crockery basket side wall. The hooks of the first/second holding means can be arranged along the bearing strut of the storage tray for items to be washed and in each case grip around the cross wire of the crockery basket side wall.

For a space-reducing design of the first and second holding means, their hooks can be arranged at right angles to the tilting axes of the storage tray for items to be washed, in each case in alignment in series one behind the other.

For reliable holding it is advantageous to have a favorable force introduction of the storage tray for items to be washed supported by means of the tilting moment into the crockery basket side wall. Against this background it is preferable for the bearing strut of the storage tray for items to be washed to be supported not only in a punctiform manner, but in a planar manner against the crockery basket side wall. To this end, the bearing strut can have two partial areas angled with respect to each other, assigned respectively to the knife storage position and the cup storage position of the storage tray for items to be washed. For example, in the knife storage position, the first partial area can lie in a planar manner on a cross wire and/or longitudinal wire of the crockery basket side wall, while, in the cup storage position, the second partial area of the bearing strut abuts the side wall.

In order to ensure the storage tray for items to be washed is securely and reliably folded up when the crockery basket is loaded, the first and/or second holding means can comprise a securing element with which the hinged storage tray for items to be washed is secured during the folding-up action. Preferably, only the holding means assigned to the lower cup storage position can have a securing element of this kind. On the other hand, the holding means assigned to the upper knife storage position can be only loosely suspended by means of the hook. This is especially advantageous when the upper crockery basket is inserted into the washing container with the storage tray for items to be washed folded up. In this case the folded-up storage tray for items to be washed abuts the upper opening edge of the washing container. Since the holding means assigned to the knife storage position is only loosely suspended, the folded-up storage tray for items to be washed can be released from the crockery basket side wall without damage.

The storage tray for items to be washed can have on its side protruding into the interior of the crockery basket positioning aids spaced apart from one another, between the side flanks of which items to be washed, for example glasses, can be stacked. By means of the lateral positioning aids the glasses placed on the base of the crockery basket can retain their stacked position during washing.

Additionally or alternatively thereto, the storage tray for items to be washed can have on its upper tray side raised positioning aids for placing items to be washed, for example knives. The raised positioning aids can on the one hand be closed, elongated side walls on which knives or other objects can be placed.

Alternatively it is also possible for upward-protruding studs to be molded-on, onto which cups with openings facing downward can be placed.

In a development it is provided that the storage tray for items to be washed is configured to be adjustable in height. This enables, for example, the clear height between the base of the crockery basket and the storage tray for items to be washed to be adjusted as required in order, for example, to enable correspondingly tall items to be washed in this interspace. Conversely it is also possible to adjust the clear height between the storage tray for items to be washed and the washing container roof of a dishwasher in order, for example, to be able to place cups on the storage tray for items to be washed. This provides greater variability.

Moreover, it is provided in a development that the storage tray for items to be washed is adjustable between a first height position assigned to the first storage position and a second height position assigned to the second storage position. In this case the first storage position can be the upper of two height positions in which, for example, knives can be stored in a knife storage position, while the second storage position is the lower of the two positions in which, for example, cups can be stored in a cup storage position.

BRIEF DESCRIPTION OF THE DRAWINGS

An exemplary embodiment of the invention is described below with reference to the attached figures, in which.

DETAILED DESCRIPTION OF EXEMPLARY EMBODIMENTS OF THE PRESENT INVENTION

Figure 1:
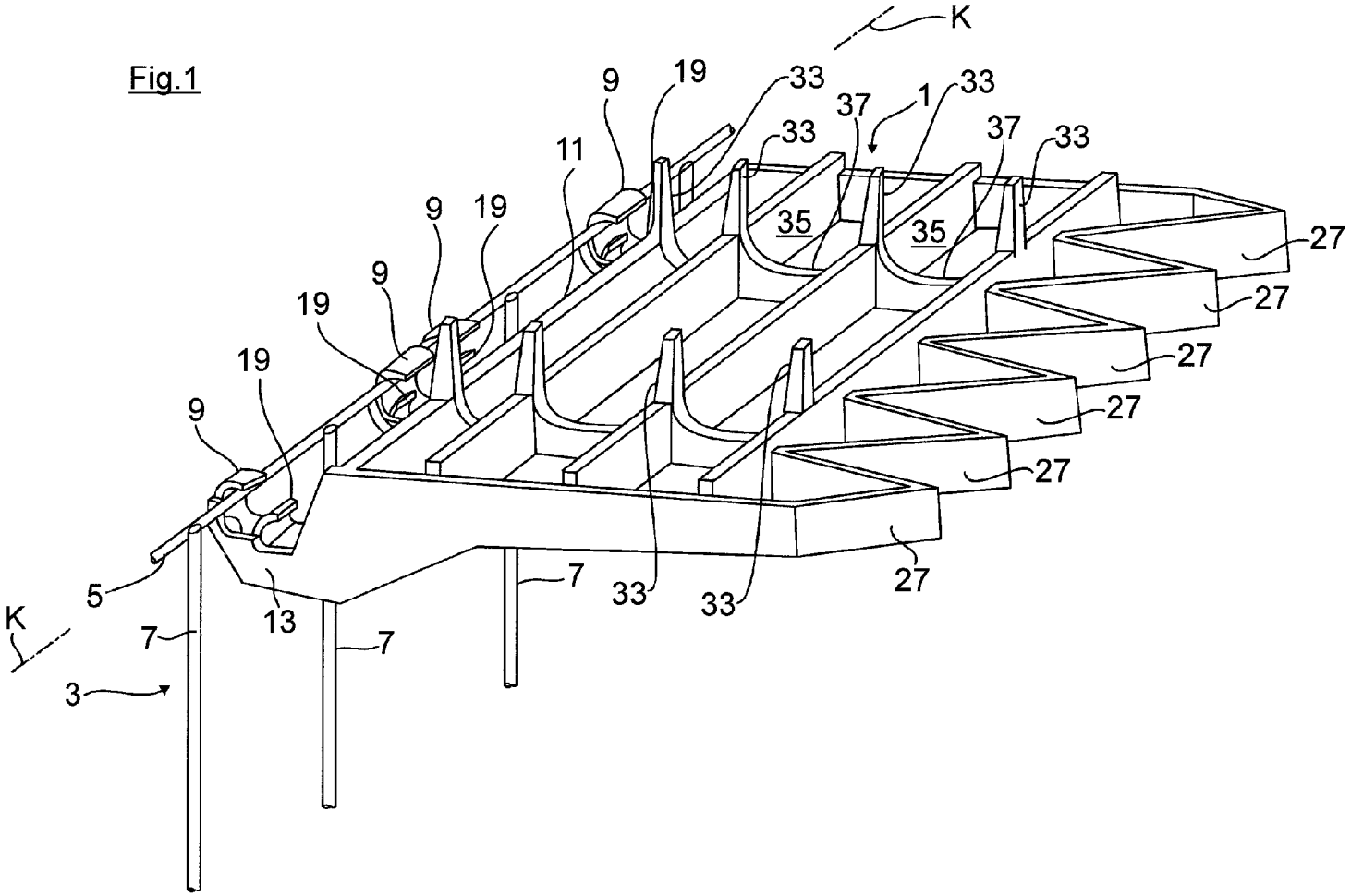
FIG. 1 shows in an enlarged perspective partial view an upper crockery basket with suspended storage tray for items to be washed.

FIG. 1 shows a storage tray 1 for items to be washed in one mounting position. The storage tray 1 for items to be washed, normally embodied as a plastic injection-molded part, is held in a known way in an upper crockery basket of a dishwasher (not shown here). For clarity of illustration purposes, with respect to the upper crockery basket, FIG. 1 shows only a side wall 3 of the upper crockery basket as necessary to describe the invention in which the storage tray 1 for items to be washed is suspended. As may be seen in FIG. 1, the crockery basket has on its side wall three cross wires 5 and vertically aligned longitudinal wires 7.

According to FIG. 1, the storage tray 1 for items to be washed is embodied with lateral first holding means 9 of a holding device which are hinged on the upper cross wire 5 of the crockery basket side wall 3. According to FIG. 1, in the present exemplary embodiment, the first holding means 9 are embodied as a total of four suspension hooks extending along a bearing strut 11 of the storage tray 1 for items to be washed. Each of the suspension hooks 9 is molded laterally on the storage tray 1 for items to be washed via two connecting bridges 13 spaced apart from each other.

Figure 2:
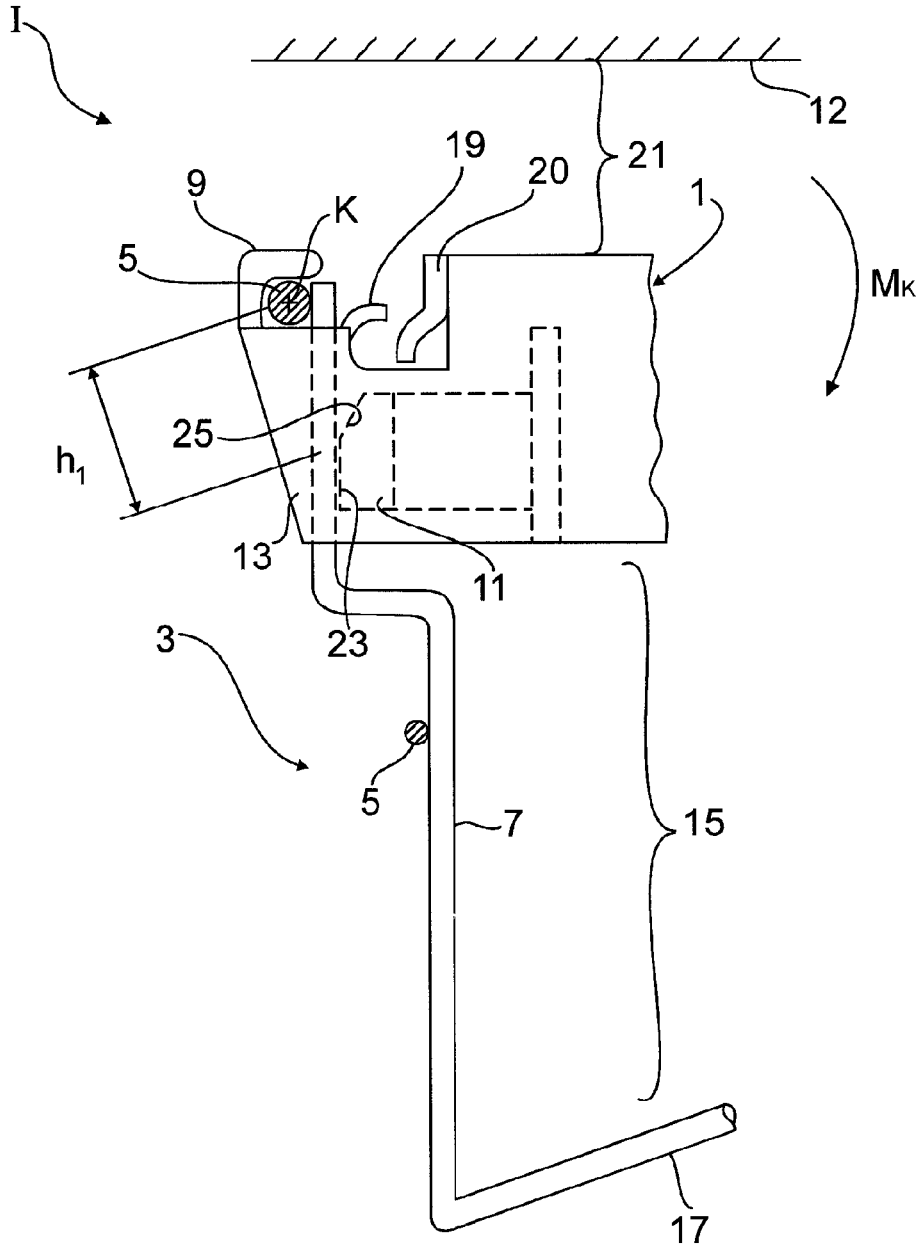
FIGS. 2 and 3 show in a schematic representation in each case a storage tray for items to be washed suspended in an upper knife storage position and a storage tray for items to be washed suspended in a lower cup storage position.

As may be seen in FIGS. 1 and 2, the storage tray 1 for items to be washed held on the crockery basket by the suspension hooks 9 is hinged about a tilt axis K on the upper cross wire 5. Due to gravitational force, a tilting moment $M_K$ acts on the storage tray 1 for items to be washed hinged in this way, said tilting moment pressing the bearing strut 11 of the storage tray 1 for items to be washed laterally against the crockery basket side wall 3. The bearing strut 11 is in this case spaced apart from the tilt axis K by a first effective lever arm length $h_1$. The effective first lever arm length $h_1$ is dimensioned in such a way that the storage tray 1 for items to be washed can be supported with its bearing strut 11 in approximately horizontal alignment against the crockery basket side wall 3.

FIGS. 1 and 2 show the storage tray 1 for items to be washed in its upper knife storage position I, in which, between the storage tray 1 for items to be washed and an indicated cover wall 12 of the washing container of the dishwasher, only a reduced stacking space 21 is available to use for stacking knives or other pieces of cutlery. In contrast, a lower stacking space 15 between the crockery basket base 17 and the storage tray 1 for items to be washed is correspondingly enlarged.

In addition to the first holding means 9 already mentioned, in the present exemplary embodiment, the holding device comprises on the storage tray 1 for items to be washed further second holding means 19 embodied as further suspension hooks, arranged laterally offset toward the interior with respect to the outer suspension hooks 9. Like the suspension hooks 9, the suspension hooks 19 are arranged along the bearing strut 11. The suspension hooks 19 are in this case each arranged transversely between the connecting bridges 13 for the suspension hooks 9 so that the hooks 9, 19 are arranged in pairs aligned in series one behind the other each at a right angle to the tilt axis K.

Figure 3:
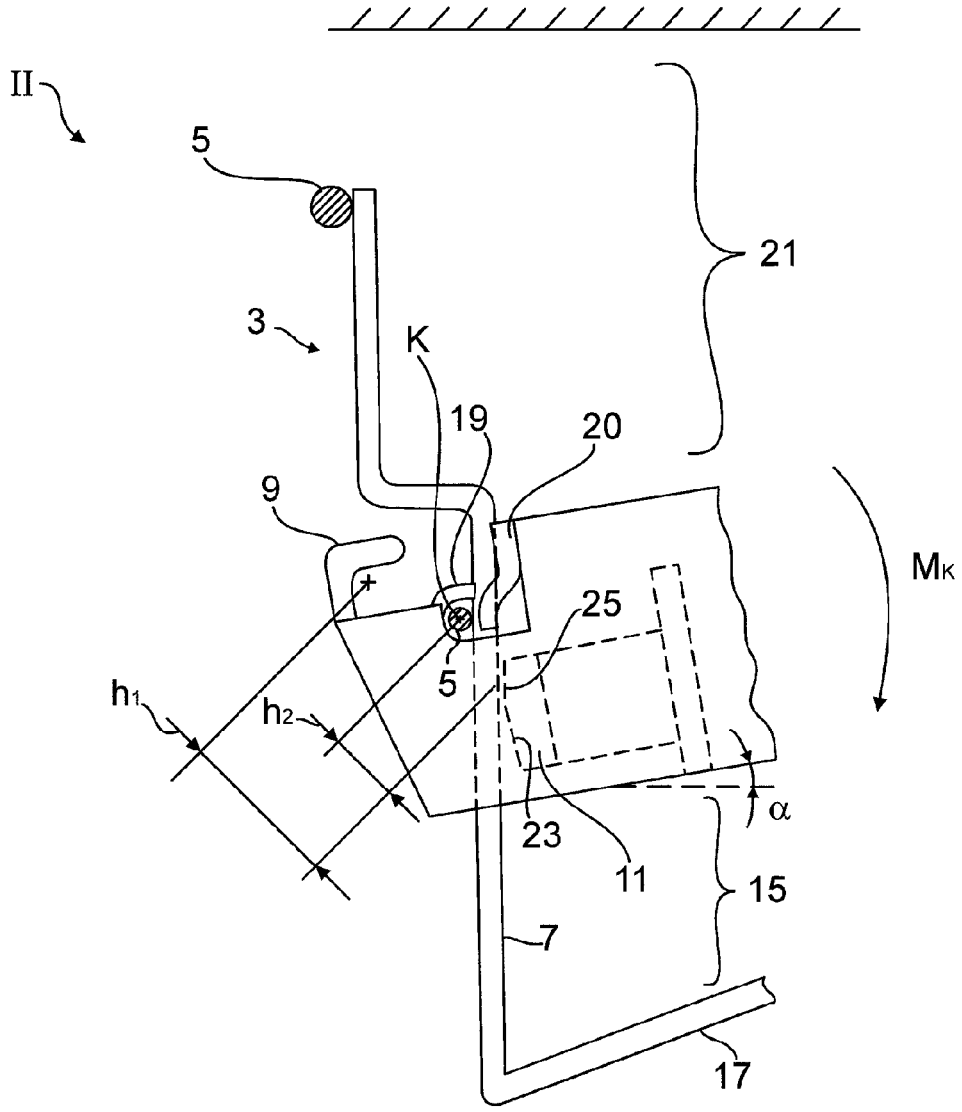

In FIG. 3, in contrast to FIGS. 1 and 2, the storage tray 1 for items to be washed is arranged, not in the upper knife storage position I, but in the lower cup storage position II. To this end, the storage tray 1 for items to be washed is suspended with its suspension hooks 19 engaged in a lower cross wire 5 which is implemented with a reduced diameter compared with the upper cross wire 5. The suspension hooks 19 are adapted to the reduced diameter of the lower cross wire 5.

Similarly to the laterally outer suspension hook 9, the inner suspension hook 19, together with the lower cross wire 5, also forms a tilt axis K about which the storage tray 1 for items to be washed presses downward via a tilting moment $M_K$. The bearing strut 11 is supported by means of the tilting moment $M_K$ against the crockery basket side wall 3.

The effective lever arm length $h_2$ between the tilt axis K and the bearing strut 11 shown in FIG. 3 is in this case dimensioned such that the storage tray 1 for items to be washed is inclined at an angle $\alpha$ in an order of magnitude of 20 to 30° upward from the horizontal plane.

In the lower cup storage position II shown in FIG. 3, the stacking space 21 above the storage tray 1 for items to be washed is larger than the knife storage position, while the stacking space 15 beneath the storage tray 1 for items to be washed is smaller. This enables comparatively large pieces of cutlery and/or crockery to be stacked on the storage tray 1 for items to be washed.

For a stable holding of the storage tray 1 for items to be washed in its knife storage and cup storage position I, II, the bearing strut 11 on its side facing the crockery basket side wall 3 can be embodied with partial areas 23, 25 inclined with respect to each other, as shown in FIGS. 2 and 3. In FIG. 2, the lower vertical partial area 23 of the bearing strut 11 abuts the crockery basket side wall 3 in a planar manner. On the other hand, according to FIG. 3, in the cup storage position II of the storage tray 1 for items to be washed, the upper angled partial area 25 of the bearing strut 11 abuts the crockery basket side wall 3 in a planar manner.

Figure 4:
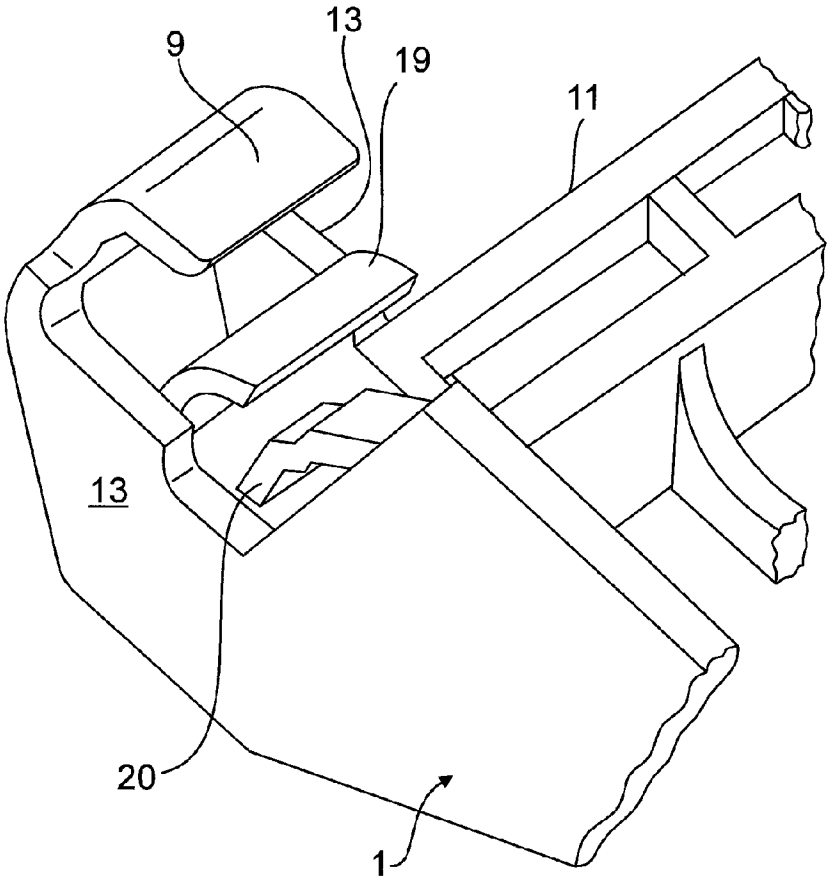
FIG. 4 shows in an enlarged detail view holding means of the storage tray for items to be washed for suspension in the crockery basket.

As is further evident from FIGS. 2 to 4, the inner suspension hooks 19 are each assigned opposing elastically flexible latch elements 20. In the cup storage position II shown in FIG. 3, these secure the storage tray 1 for items to be washed on the cross wire 5 against unintentional loosening. In this way, in its cup storage position II, the storage tray 1 for items to be washed can be folded up reliably into a vertical position parallel to the crockery basket side wall 3. On the other hand, a latch fastening of this kind is not provided in the knife storage position I according to FIG. 3. This means that when the storage tray 1 for items to be washed is in the knife storage position and is folded upward, no latch fastening of this kind takes place. This enables damage to the inadvertently upward-tilted storage tray 1 for items to be washed to be avoided when the upper crockery basket is inserted into the washing container. Instead, it would be possible to detach the folded-up storage tray 1 for items to be washed from the crockery basket without damage.

Figure 5:
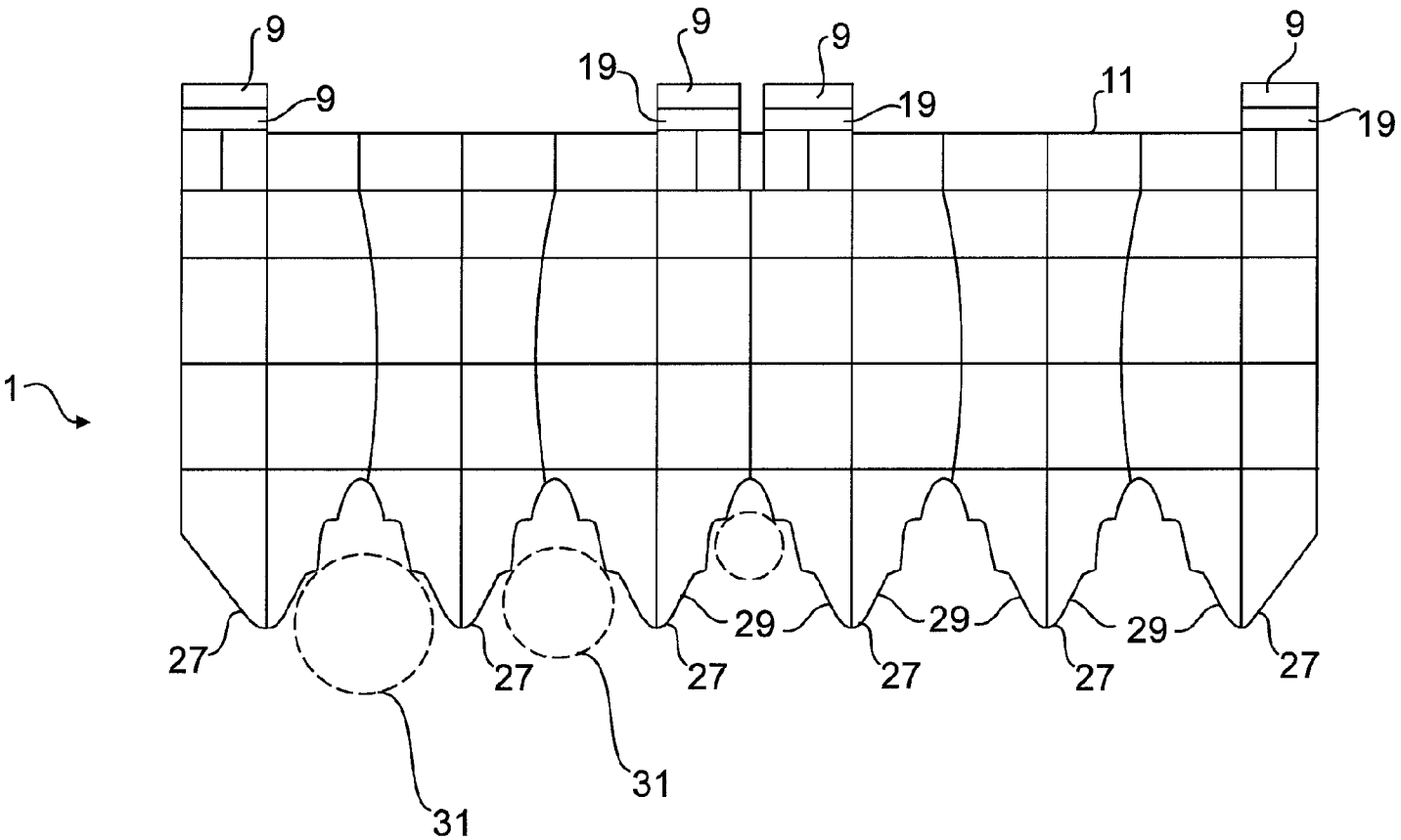
FIG. 5 shows in a view from above the storage tray for items to be washed on its own.

FIG. 5 is a rough schematic diagram of the storage tray 1 for items to be washed on its own. According to this, the storage tray 1 for items to be washed is embodied in approximately a grid shape with longitudinal and side struts. On its side facing the suspension hooks 9, 19, the storage tray 1 for items to be washed is extended by spaced-apart positioning aids 27 which, in the installed state, protrude into the interior of the crockery basket. The graduated side flanks 29 of the positioning aids 27 delimit triangular recesses into which the indicated pieces of crockery 31 with different diameters can be placed.

The storage tray 1 for items to be washed comprises additional positioning aids in the form of positioning studs 33 protruding upward from the side of the tray and upward-extending side walls 35, as shown in FIG. 1. Storage channels 37 are embodied between the side walls 35. The raised side walls 35 serve as seating surfaces for knives or other objects, while the positioning studs 33 can serve for example to position cups placed upside down.

LIST OF REFERENCE SIGNS

1 Storage tray for items to be washed
3 Crockery basket side wall
5 Cross wires
7 Longitudinal wires
9 First holding means
12 Cover wall of the washing container
13 Connecting bridges
15 Lower stacking space
17 Crockery basket base
19 Second holding means
21 Upper stacking space
23, 25 Partial areas of the bearing strut 11
11 Bearing strut
27 Positioning aids
29 Side flanks
31 Items to be washed
33 Positioning aids
35 Raised side walls
37 Storage channels
$h_1$ First effective lever arm length
$h_2$ Second effective lever arm length
K Tilt axis
$\alpha$ Angle of the storage tray for items to be washed in its knife storage position I
$M_K$ Tilting moment of the storage tray for items to be washed
I Knife storage position
II Cup storage position

The invention claimed is:

1. A dishwasher, comprising:

a crockery basket having a storage tray to support items to be washed, the storage tray having at least one holding device, wherein the holding device is configured for engagement with a first section of a side wall of the crockery basket for attachment of the holding device to the crockery basket in a first storage position of the storage tray, and wherein the holding device is constructed for engagement with a second section of the side wall of the crockery basket for attachment of the holding device to the crockery basket in a second storage position of the storage tray, wherein the storage tray has a storage surface configured to support the items to be washed in both the first storage position and in the second storage position, the storage tray being suspended from the side wall in the first and second storage positions such that the storage surface extends inwardly over a base of the crockery basket and at an angle with the side wall, wherein the storage surface is oriented at a first angular position with respect to the crockery basket in the first storage position, and the storage surface is oriented at a second angular position with respect to the crockery basket in the second storage position, and wherein the storage surface in the first angular position forms a different angle with the side wall than in the second angular position.

2. The dishwasher of claim 1, wherein the at least one holding device comprises at least one first holding device constructed for engagement with the first section of the crockery basket and at least one second holding device constructed for engagement with the second section of the crockery basket.

3. The dishwasher of claim 1, wherein the crockery basket is formed at least in sections from wires embodied as cross wires or longitudinal wires, or both, and wherein the holding device is constructed for engagement with at least one of a cross wire or a longitudinal wire in a corresponding first or second section of the crockery basket.

4. The dishwasher of claim 3, wherein the holding device is constructed for engagement with at least one cross wire in the first section.

5. The dishwasher of claim 3, wherein the holding device is constructed for engagement with at least one cross wire in a corresponding first or second section.

6. The dishwasher of claim 3, wherein the holding device is constructed for engagement with at least one longitudinal wire in a corresponding first or second section.

7. The dishwasher of claim 3, wherein the cross wires or longitudinal wires, or both, in the first section of the crockery basket have a different cross-section than the cross wires or longitudinal wires, or both, in the second section.

8. The dishwasher of claim 7, wherein the cross-sections are substantially round.

9. The dishwasher of claim 8, wherein the cross-sections have different diameters.

10. The dishwasher of claim 1, wherein in the first storage position, the storage tray has a different spacing from a crockery basket base than in the second storage position.

11. The dishwasher of claim 1, wherein the storage tray is arranged closer to the basket base in the second storage position than in the first storage position, and the storage surface in the second storage position has a greater angle of inclination above horizontal than in the first storage position.

12. The dishwasher of claim 11, wherein a difference in the angle of inclination in the first angular position and the second angular position is in a range of 0 to 45°.

13. The dishwasher of claim 11, wherein a difference in the angle of inclination in the first angular position and the second angular position is in a range of 25-30°.

14. The dishwasher of claim 3, wherein the holding device is constructed for engagement with a cross wire.

15. The dishwasher of claim 2, wherein the at least one first and second holding devices are embodied as hooks.

16. The dishwasher of claim 1, wherein the storage tray is constructed to be brought from a non-usage position at least into the first storage position or the second storage position by a swiveling motion.

17. The dishwasher of claim 1, wherein the first storage position of the holding device is a position configured for storing knifes and the second storage position is a position configured for storing cups.

18. The dishwasher of claim 1, wherein in the first storage position, the storage tray is held on the crockery basket approximately in a horizontal plane.

19. The dishwasher of claim 1, wherein in the second storage position, the storage tray is held on the crockery basket at an angle inclined upward from a horizontal plane.

20. The dishwasher of claim 1, wherein the storage tray comprises a bearing strut supported against the side wall of the crockery basket with a tilting moment.

21. The dishwasher of claim 2, wherein the at least one first holding device and the at least one second holding device are arranged sequentially one after another.

22. The dishwasher of claim 21, wherein the at least one first holding device and the at least one second holding device are arranged sequentially one after another at a right angle to a tilt axis of the storage tray.

23. The dishwasher of claim 20, wherein in the first storage position a tilt axis is spaced apart from the bearing strut by a first effective lever arm length, and in the second storage position the tilt axis is spaced apart from the bearing strut by a second effective lever arm length which is different from the first effective lever arm length.

24. The dishwasher of claim 20, wherein the bearing strut comprises a bearing surface having first and second partial areas which are inclined with respect to each other, with the first partial area of the bearing strut abutting the crockery basket side wall in the first storage position and the second partial area of the bearing strut abutting the crockery basket side wall in the second storage position.

25. The dishwasher of claim 1, wherein the at least one holding device has at least one securing element constructed to secure the storage tray in a non-usage position.

26. The dishwasher of claim 1, wherein the storage tray comprises raised positioning aids disposed on the storage surface for positioning the items to be washed.

27. The dishwasher of claim 1, wherein the angle with the side wall is greater in the second storage position than in the first storage position.

28. A dishwasher, comprising:

a crockery basket having a storage tray to support items to be washed, the storage tray having first and second holding devices, wherein the first holding device is constructed for engagement with a first section of a side wall of the crockery basket for attachment of the holding device to the crockery basket in a first storage position of the storage tray, wherein the second holding device is constructed for engagement with a second section of a side wall of the crockery basket for attachment of the holding device to the crockery basket in a second storage position of the storage tray, wherein the storage tray has a storage surface configured to support items to be washed in both the first storage position and in the second storage position, the storage tray being suspended from the side wall in the first and second storage positions such that the storage surface extends inwardly over a base of the crockery basket and at an angle with the side wall, and wherein the first holding device is configured to be unattached to the crockery basket when the storage tray is in the second storage position.

29. The dishwasher of claim 28, wherein the second holding device is configured to be unattached to the crockery basket when the storage tray is in the first storage position.

30. The dishwasher of claim 29, wherein the first and second holding devices are embodied as hooks.

* * * * *